United States Patent [19]

Wilson

[11] Patent Number: 4,704,953

[45] Date of Patent: Nov. 10, 1987

[54] POWDER SPRAY SYSTEM

[75] Inventor: Scott T. Wilson, Bay Village, Ohio

[73] Assignee: Nordson Corporation, Westlake, Ohio

[21] Appl. No.: 930,008

[22] Filed: Nov. 12, 1986

[51] Int. Cl.[4] ..... B05B 15/12

[52] U.S. Cl. ..... 98/115.2; 55/96; 55/302; 118/326

[58] Field of Search ..... 55/96, 302; 98/115.2; 118/326, 612, 634, DIG. 7

[56] References Cited

U.S. PATENT DOCUMENTS

| | | | |
|---|---|---|---|
| 1,629,032 | 5/1927 | Goodridge . | |
| 2,602,707 | 7/1952 | Garoutte . | |
| 3,204,390 | 9/1965 | Heyl | 55/341 |
| 3,370,404 | 2/1968 | Leeper | 55/233 |
| 3,719,030 | 3/1973 | Blankemeyer | 98/115.2 X |
| 3,733,011 | 5/1973 | Driscoll | 222/193 |
| 3,746,254 | 7/1973 | Duncan et al. | 239/15 |
| 3,814,002 | 6/1974 | Rombach et al. | 98/115.2 |
| 3,870,375 | 3/1975 | Duncan et al. | 302/42 |
| 3,905,785 | 9/1975 | Fabre | 98/115.2 X |
| 4,094,654 | 6/1978 | Prinzing | 98/115.2 X |
| 4,133,255 | 1/1979 | Guice | 98/115.2 |
| 4,245,551 | 1/1981 | Berkmann | 98/115.2 |
| 4,277,260 | 7/1981 | Browning | 98/115.2 X |
| 4,354,451 | 10/1982 | Vohringer et al. | 98/115.2 X |
| 4,378,728 | 4/1983 | Berkmann | 98/115.2 |
| 4,380,320 | 4/1983 | Hollstein et al. | 239/697 |
| 4,395,269 | 7/1983 | Schuler | 55/302 |
| 4,454,832 | 6/1984 | Gernez | 118/634 |
| 4,471,715 | 9/1984 | Gubler et al. | 118/326 X |
| 4,498,913 | 2/1985 | Tank et al. | 98/115.2 X |
| 4,504,292 | 3/1985 | Vohringer | 98/115.2 X |
| 4,506,625 | 3/1985 | Vohringer | 118/326 X |
| 4,545,324 | 10/1985 | Browning | 118/634 |

FOREIGN PATENT DOCUMENTS

| | | | |
|---|---|---|---|
| 2088744 | 6/1982 | United Kingdom | 55/341.7 |

*Primary Examiner*—Harold Joyce

*Attorney, Agent, or Firm*—Wood, Herron & Evans

[57] ABSTRACT

A powder spray system including a powder spray booth through which product is conveyed past a spray gun mounted adjacent the booth to spray charged particles into the booth. A chamber containing a fan and final filters is located beneath the booth. A movable powder collector having a plurality of filter cartridges and a powder collection hopper is movable beneath the booth into sealed engagement with the hopper and with the chamber containing the fan and final filters. Mounted upon the powder collector there is a feed hopper into which a transfer pump is operable to pump powder from the collection hopper. A movable sieve is mounted upon the inlet end of a hose which supplies powder from a fluidizing bed at the bottom of the powder collection hopper into the transfer pump. An overflow outlet opening interconnects the feed hopper and the powder collection hopper, and the pump flows are adjusted so that powder is maintained in the feed hopper at the level of the overflow outlet opening.

18 Claims, 8 Drawing Figures

POWDER SPRAY SYSTEM

This invention relates to a powder spray booth and powder collector for collecting oversprayed powder particles from the booth and returning the powder to spray guns associated with the powder booth.

Powder spray systems conventionally comprise a powder spray booth, a conveyor for transporting product through the booth, and spray guns for delivery of charged powder particles toward the product. The nature of such systems is that conventionally 50 percent or more of the sprayed powder does not adhere to the product and must be collected. Different arrangements have been provided for collecting the oversprayed powder and returning those particles to the spray guns. One such system described in Berkmann U.S. Pat. No. 4,245,551 provides for interchangeable powder collectors which are movable into position adjacent to the booth to provide a first stage of collecting oversprayed powder. Interchangeable collectors are proposed in this patent in order to permit color changes to be made in the powder sprayed in the booth. Generally, powder collected in these first-stage collectors is pumped to a sieve wherein the powder is separated from foreign matter and then returned to the guns from a feed hopper associated with the sieve. Such typical systems require relatively expensive interchangeable collectors and sieves for cleaning the powder before it can be returned to the powder spray guns.

There has been a need for a relatively small, low-cost color change powder spray system which does not involve all of the equipment costs heretofore associated with such systems. It has been one objective of this invention to satisfy that need.

Still another objective of this invention has been to provide an improved, relatively inexpensive powder spray system, which includes a powder collector operable to collect the powder, transport it to a feed hopper, and from the feed hopper return it to the powder spray guns without the need for an auxilliary sieve mounted remote from the collector while still separating the powder from foreign contaminants and preventing those contaminants from being returned to the spray guns. To that end, the invention of this application includes an improved powder sieve mounted in the powder collector and operable to separate foreign matter from the powder before the powder is transported from a collection hopper to a feed hopper by a transfer pump.

Still another objective of this invention has been to provide an improved sieve and method of cleaning that sieve which precludes the sieve from becoming clogged with powder and foreign matter.

According to one aspect of this invention, a very light, cylindrical powder sieve is mounted upon a light, flexible hose in the bottom of a fluidized bed powder collection hopper. The sieve is sufficiently lightweight and the hose upon which the sieve is mounted is sufficiently flexible that air turbulence in the powder fluidizing bed is operable to maintain the sieve in motion, preferably moving it over the air pervious surface of the fluidizing bed, so as to shake and disengage from the surface of the sieve powder and contaminants which would, in the absence of such motion, clog the surface of the sieve. As a consequence of this construction and location of the sieve, powder and contaminants do not clog the sieve and clean powder is passed through the sieve and transported by a transfer pump to a powder feed hopper.

Yet another aspect of this invention is predicated upon a novel construction of a powder collection hopper and powder feed hopper which cooperate to reduce puffing of powder supplied to the powder spray guns and subsequently discharged from the guns. According to this aspect of the invention, fluidized powder is maintained at a fixed level in the feed hopper. This level is determined by an overflow passage which interconnects the feed hopper directly to the substantially larger capacity powder collection hopper. A greater quantity of powder than is required at the spray guns is pumped by a transfer pump from the powder collection hopper to the feed hopper with the result that the level of fluidized powder in the feed hopper is always maintained at the level of the overflow passage between the feed hopper and the powder collection hopper. Maintenance of a constant level of powder in the feed hopper has been found to substantially reduce powder flow rate variances which had heretofore been a problem in maintaining a constant flow rate of powder from spray guns connected to the feed hopper.

Still another objective of this invention has been to provide an improved color change powder spray system which may be very quickly changed from one powder to another. To facilitate this quick color or powder change, the invention of this application incorporates quick disconnect pneumatic plates having multiple matching parts. One of these plates is attached by lfexible air lines to a pneumatic control panel of the system, and the other plate is mounted upon the collector and connected by air lines to the pneumatic pumps and fluidizing beds of the movable collector. As a consequence of this connection, complete collectors may be very quickly interchanged in the system.

The objectives set forth hereinabove are achieved by the invention of this application which comprises a powder supporting table, at one end of which there is mounted a chamber containing a fan and final filters, as well as a pneumatic control panel. The fan is so located in the chamber that it is operable to draw air into the chamber and pass it out of the chamber through the final filters. A powder spray booth is mounted atop the table. The center of the table is open so as to provide a flow path for powder from the booth into a powder collector rolled beneath the opening in the table. The powder collector has mounted on its top surface a grate beneath which there is a powder collection hopper. Between the grate and the powder collection hopper are four filter cartridges arranged in two rows with the axes of the cartridges being horizontal. These cartridges function to separate the powder from the air in which the powder is entrained when it leaves the booth. At the bottom of the powder collection hopper there is a fluidizing bed chamber operable to fluidize powder contained in the collection hopper. Fluidized powder is pumped by a transfer pump from the powder collection hopper into a feed hopper mounted on one end of the powder collector. The feed hopper also has a fluidizing bed chamber mounted on its underside and operable to fluidize powder contained within the feed hopper. A powder feed pump is operable to transport powder from the feed hopper back to powder spray gun associated with the powder booth. Between the powder feed hopper and the powder collection hopper there is an overflow passageway or opening by means of which excess powder collected in the feed hopper automatically flows into the collection hopper. In practice, powder is maintained inthe feed hopper at the level of the overflow passage.

When the powder collector is moved beneath the support table, it is sealingly engaged with the underside of the table and with the fan and final filter containing chamber at one end of the table. The pneumatic lines of the collector are sealingly attached to the pneumatic lines of the control panel contained within the chamber. With the fan operating, air is drawn through the booth downwardly through the grate of the collector into the filter cartridges contained in the collector. Air is drawn by the fan from the interior of the filter cartridges into the fan containing chamber and then discharged to the atmosphere through the final filters. Associated with the filter cartridges there are reverse air flow jets operable to periodically discharge a short blast of high pressure air into the interior of the cartridges from the end opposite to the end connected to the fan containing chamber. These periodic bursts of high pressure air are operable to clean the surfaces of the cartridges and prevent them from becoming clogged with powder.

Control panels for the electrical and pneumatic controls of the powder spray system are mounted on either side of the fan containing chamber of the system. When the powder collector is moved beneath the table and into contact with the fan containing chamber, the pneumatic hoses and electrical controls contained within the powder collector are aligned with and quickly connected to electrical leads and pneumatic hoses of the system contained within the control panels.

The objectives and advantages of this invention will become more readily apparent from the following detailed description of the drawings in which.

Figure 1:
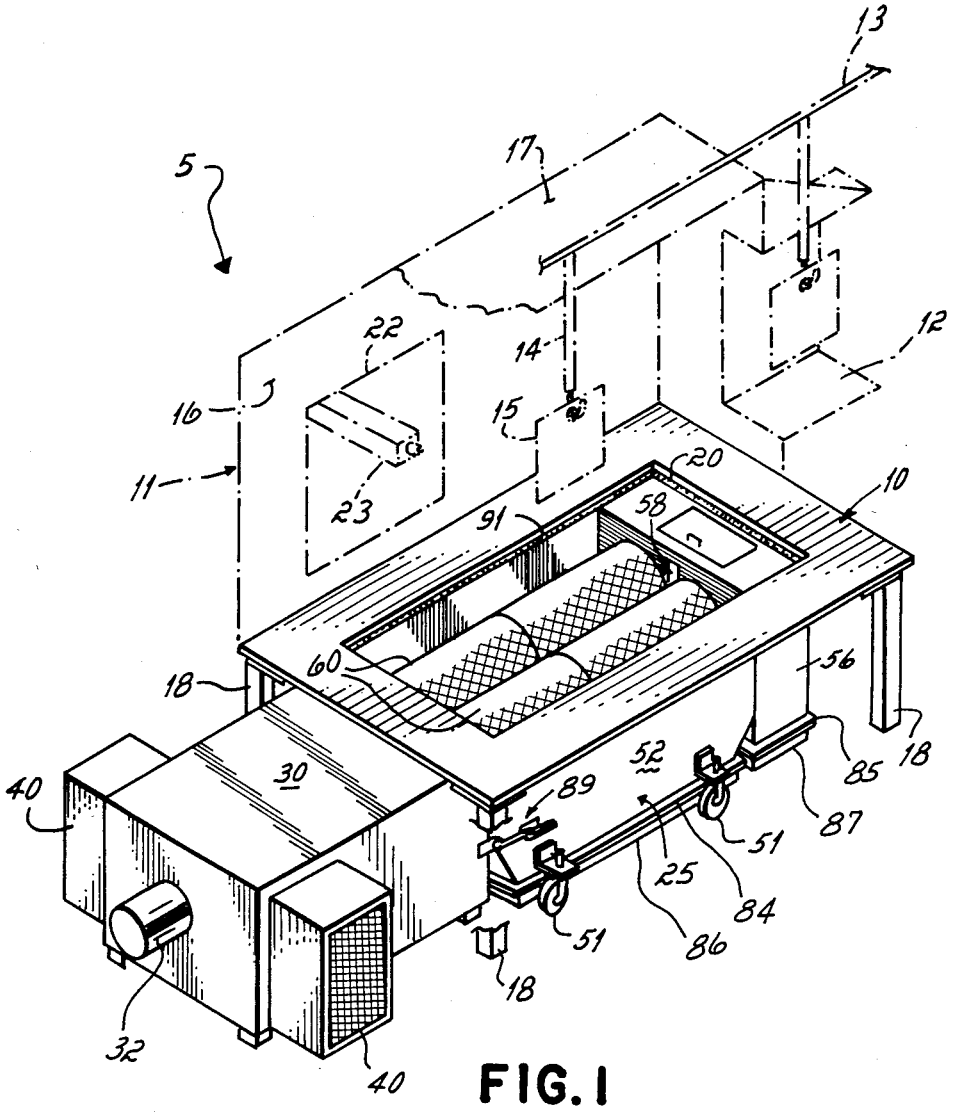
FIG. 1 is a perspective view, partially in phantom, of a powder spray system incorporating the invention of this application.

Referring first to FIG. 1, there is illustrated a spray system 5 including supporting table 10 upon which a powder spray booth 11 is mounted. For purposes of clarity of the drawings and this invention, the booth 11 is illustrated in phantom and partially broken away in FIG. 1. The booth 11 has end openings or vestibules 12 (only one of which is illustrated in FIG. 1) through which a conveyor 13 having hangers 14 supporting product 15 to be sprayed passes. At least one window 22 is provided in the vertical side walls of the booth through which spray guns 23 project. Powder from the spray guns 23 is projected onto the products 15 as those products move through the booth and past the spray gun.

While only one vertical side wall 16 and one-half of the top wall 17, as well as only one-half of an end vestibule 12, have been illustrated in phantom in FIG. 1, persons skilled in this art will appreciate that a powder spray booth is generally tunnel-shaped, having a pair of opposed side walls 16, a top wall 17 slotted so as to facilitate the passage of the conveyor brackets 14 therethrough, and a pair of end vestibules 12 located at opposite ends of the booth. The tops of the vestibules are also slotted so as to facilitate the passage of the brackets 14 of the conveyor 13 therethrough.

The booth 11 of this invention is open in the bottom and rests upon the top 19 of table 10. The top 19 of the table 10 is supported from legs 18 and has a large opening 20 therein, which opening permits powder sprayed into the booth to pass downwardly through the opening 20 into a powder collector 25 located beneath the table.

Figure 3:
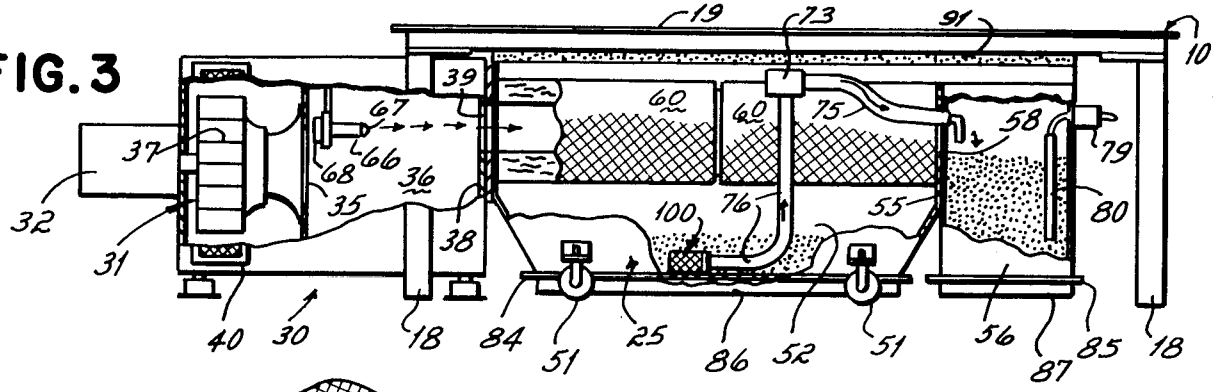
FIG. 3 is a side elevational view, partially broken away, of the portion of the powder spray system illustrated in FIG. 2.
Figure 5:
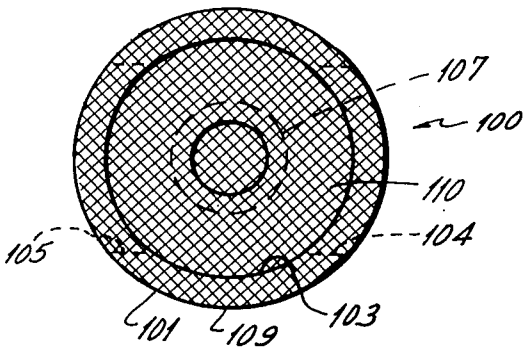
FIG. 5 is an end elevational view of the powder sieve illustrated in FIG. 4.
Figure 4:
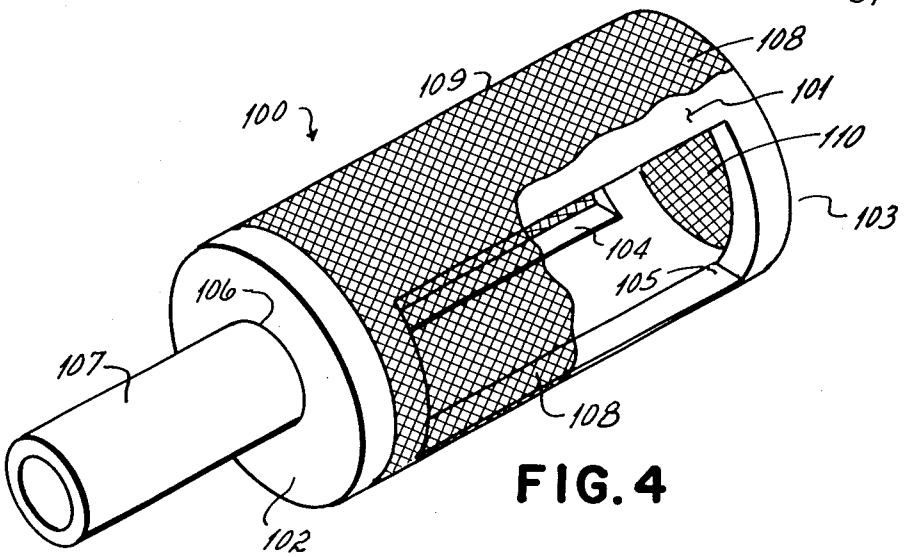
FIG. 4 is a perspective view of the powder sieve employed in the powder spray system of FIGS. 1–3.
Figure 6:
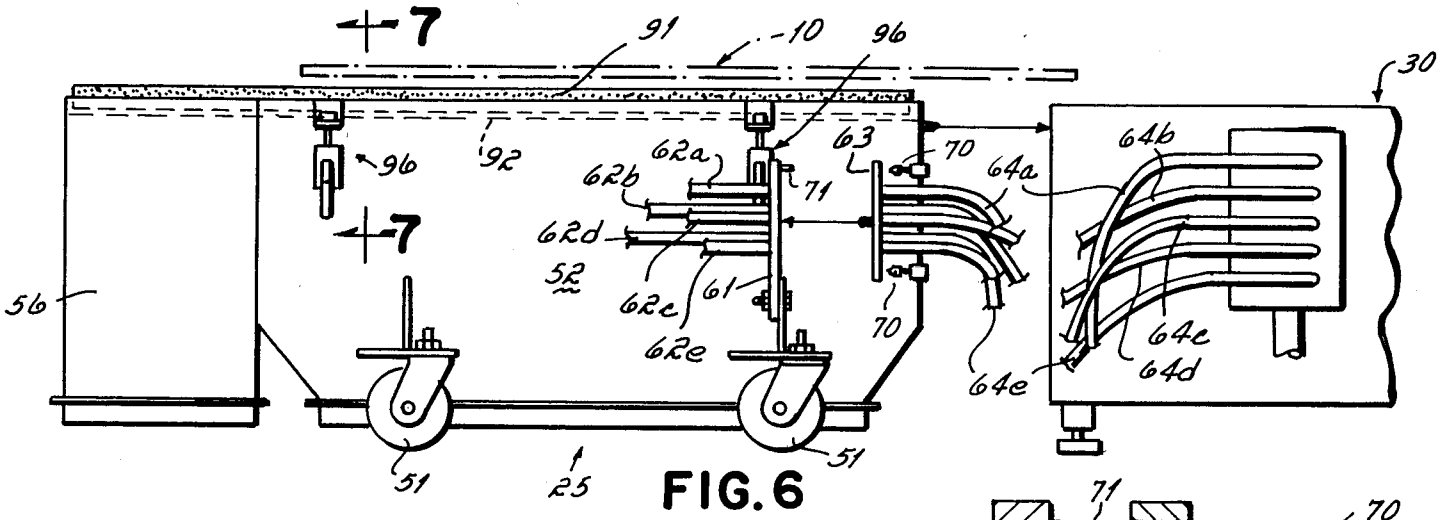
FIG. 6 is a side elevational view of the powder spray system illustrating the collector being moved into operational position beneath the table and adjacent the chamber.
Figure 8:
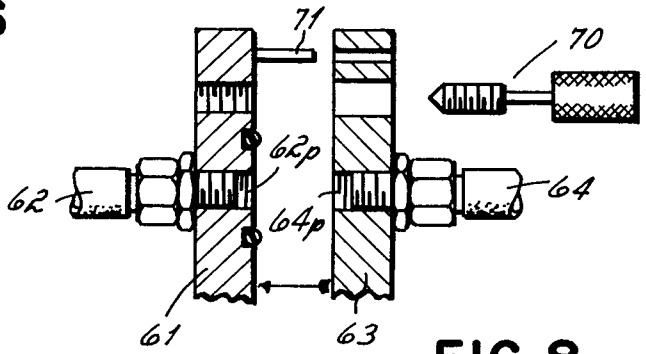
FIG. 8 is an enlarged cross-sectional view partially broken away, of a pneumatic quick disconnect device utilized in the powder spray system of this invention.

Located beneath and attached to one end of the table 10 is a chamber 30 containing a radial fan 31 driven by a motor 32. The fan is connected through an opening 35 (FIG. 3) to an intermediate chamber 36 and draws air from that intermediate chamber 36 through the opening 35 and directs it radially outwardly through the radial fins 37 of the fan 31. The chamber 36 has a downstream wall 38. The wall 38 has holes 39 through which air is drawn, as will be discussed below.

A pair of final filters 40 are located at the upstream end of the chamber 30. The air emanating from the fan 31 passes through these filters where final particles are picked up before the clean air enters the atmosphere surrounding the spray system 5.

Figure 2:
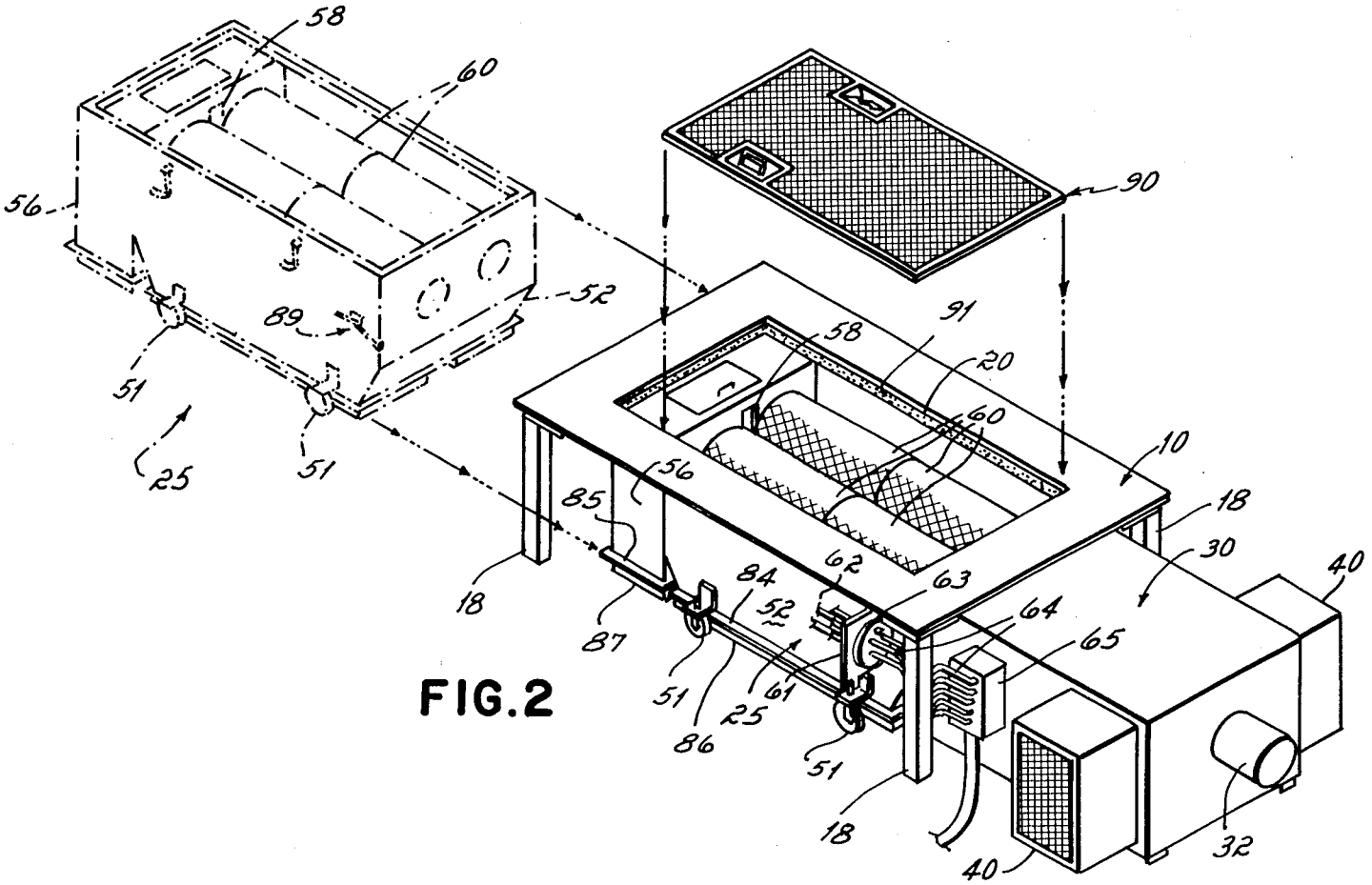
FIG. 2 is an exploded perspective view, partially in phantom, of the powder spray system of FIG. 1.
Figure 7:
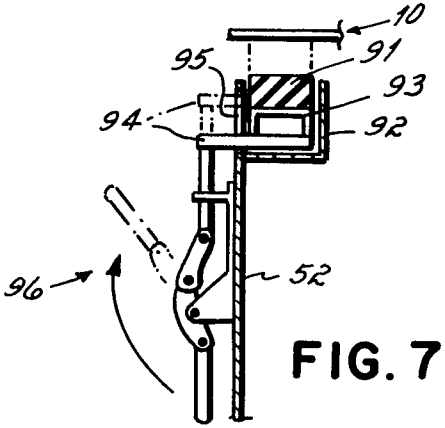
FIG. 7 is a cross-sectional view taken on line 7—7 of FIG. 6.

The collector 25 is mounted on wheels 51 which are preferably vertically adjustable casters so that the collector can be moved into the position illustrated in solid lines in FIG. 2 from the position illustrated in phantom lines in that same Figure. As there illustrated, the collector is movable longitudinally or beneath the table 10 from the end opposite the end to which the chamber 30 is attached. When located beneath the table 10, the collector is sealingly attached to the underside of the table. This sealed connection is effected by a vertically movable gasket 91 mounted around the open top edge of a poweder collector 52 mounted upon the collector 25. This gasket in top plan view is rectangular in configuration and conforms to the open top of the hopper. The gasket 91 is mounted in a channel 92 secured to the top edge of the side and end walls of the hopper 52. The underside of this gasket is mounted upon a supporting bracket 93, which bracket is attached by pins 94 extending through slots 95 in the side wall of the hopper, to a toggle mechanism 96. As illustrated in FIG. 7, actuation of the toggle mechanism 96 effects vertical movement of the gasket 91. Preferably, there are two toggle mechanisms 96 on each side of the hopper 52. The collector 25 has a powder collection hopper 52 at the bottom of the collector. Located within the collector are four cartridges 60 arranged in pairs with the axes of each pair located in a horizontal plane. Adjacent ends of each pair of cartridges 60 are sealingly secured together. The ends of the cartridges remote from the point of connection to another cartridge are sealingly connected to the end wall 38 of the intermediate chamber 36 and an end wall 55 of the collection hopper 52. A feed hopper 56 is attached to the end wall 55.

A system of reverse pulsing jets 66 is mounted in the chamber 36. Each reverse pulsing jet includes a nozzle 67 aligned with each pair of cartridge units 60. Valves 68 provide sequential and periodic pulses or bursts of high pressure air into the cartridges.

As is well known in powder collectors, powder particles are permitted to adhere to the exterior surface of the cartridges. The powder is drawn to those surfaces by the fan 31 whose low pressure end is connected to the chambers 36, thereby drawing air from the atmosphere surrounding the cartridges, through the cartridges, and into the chamber 36. At regular intervals, a reverse pulse of high pressure air is blasted through the interior of each cartridge to blow off the particles adhered to the outside peripheral surface of the cartridges, those particles then dropping down into the hopper 52 at the bottom of the collector.

Fixedly mounted on the end of the collector 25 is the feed hopper 56. It is essentially a rectangular container closed at the top to form a sealed compartment. The interior of the feed hopper is connected to the interior of the powder collection hopper 52 by a pair of hoses 75 and 76. One of these hoses functions as an intake hose to supply powder from the collection hopper to a transfer pump 73, and the other functions as a delivery hose to transport powder from the transfer pump into the interior of the feed hopper. In addition to the hose 75 interconnecting the interior of the powder collection hopper 52 to the interior of the feed hopper, there is an overflow port or passageway 58 which interconnects the interiors of the two hoppers.

To keep the powder loose and flowable, the powder collection hopper 52 and the feed hopper 56 are provided with powder fluidization chambers 86 and 87 mounted below the collection hopper 52 and the feed hopper 56, respectively. Each of these fluidization chambers is provided with an air pervious plate 84, 85 which defines the bottom of the hoppers 52 and 56, respectively. High pressure air supplied to air plenums contained in the chambers 86 and 87 blows up gently through the air pervious plates 84 and 85 and through the powder located above those plates so as to keep the powder in both hoppers in a flowable state for transfer as described herein.

Mounted upon the feed hopper 56 there is a feed pump 79 which functions to withdraw fluidized powder within the feed hopper via an inlet hose 80 and to supply that powder from the feed pump to the spray gun 23 via a hose 81. There may be more than one pump for supplying more than one spray gun, or a large capacity pump 79 may be used to supply more than one gun 23.

It is to be noted that the capacity of the powder collection hopper 52 is substantially greater than that of the feed hopper 56. It is also to be noted that the level of powder within the powder collection hopper 52 is maintained below the level of powder in the feed hopper 56 and below the level of the overflow port or passage 58 which interconnects the interior of the feed hopper to the interior of the powder collection hopper. In the use of the powder spray system 5, the flows of the pump 79 and the pump 73 are adjusted so that the pump 73 always supplies more powder fromthe powder collection hopper to the powder feed hopper than the powder feed hopper is required to supply the gun or guns 23. Consequently, the level of powder in the feed hopper is always maintained at the level of the overflow passage 58 between the two hoppers.

Applicants have found that as the level of powder in the feed hopper varies, the rate of flow of powder from the pump to the gun varies, and conversely, that if the level of powder in the feed hopper is maintained at a fixed level, the flow of powder from the pump 79 to the gun tends to be more constant or steady. This constant glow rate of powder from the pump to the gun and subsequently from the gun is desirable in order to enable an even coating of powder to be applied to products 15 as those products move past the gun 23.

In accordance with one aspect of the invention of this application, there is secured to the inlet end of the transfer pump supply hose 76 a powder sieve 100. This sieve comprises a molded plastic tubular body 101 having a one closed end 102 and an open end 103. Additionally, there are a pair of opposed openings 104, 105 in the side walls of the tube. The closed end 102 of the body has an axial bore 106 formed therein. A tubular hose fitting or nipple 107 is mounted within the bore 106. This hose fitting may be glued to the interior of the bore 106 or may be formed as a part of the body 101.

The complete periphery of the body 101 is covered by a 20-mesh nylon screen 108, which screen is glued to the outside peripheral surface 109 and the outside surface of the end wall 110 of the body. The screen thus covers the opening 103 in the end wall 110 of the body and the openings 104, 105.

In the preferred embodiment of the invention, the sieve 100 is manufactured from polyvinyl chloride material, and the nylon screen is glued to the surface of the body by conventional PVC glue. In one preferred embodiment the sieve is approximately two inches in outside diameter and has a wall thickness of approximately one-quarter of an inch. The resulting sieve is a very lightweight and inexpensive structure.

The tubular extension or nipple 107 of the sieve 100 functions as a male fitting within the inlet end of the hose 76 to the transfer pump 73. This hose is preferably a flexible hose of greater length than the vertical distance between the transfer pump 73 and the bottom wall 84 of the collection hopper 52. As a consequence of this greater length, the cylindrical sieve rests atop the top surface of the air pervious bottom wall 84 of the collection hopper 52. Because of its light weight, air flowing through the pervious wall and air turbulence contained within the feed hopper 52 is sufficient to blow or otherwise maintain the sieve in motion over the surface of the bottom wall 84 of the feed hopper. As a consequence of this constant rolling or rocking motion of the cylindrical sieve in the bottom of the hopper, the peripheral surface of the sieve is self-cleaning, and there is very little, if any, tendency for the powder, or contaminants contained within the powder, to collect on the surface of the sieve and clog that surface. The result is that this construction and location of the sieve enables it to be self-cleaning.

In order to facilitate quick color change and replacement of one collector 25 with another containing a different color or chemical composition powder, each collector has fixedly connected to its hopper 52, a quick disconnect plate 61. This plate has a plurality of ports therein. Each port in the quick disconnect plate 61 is connected to one of a plurality of air lines 62*a–e*. The air lines 62*a–e* are connected to the air supply ports of the transfer pump 73, the feed pump 79, and the fluidizing chambers 86 and 87 of the collection hopper 52 and feed hopper 56, respectively. There may be a greater number of ports in the quick disconnect plate 61 and a greater number of air lines 62, depending upon how many transfer pumps 73 and feed pumps 79 are utilized in the system.

Cooperable with the quick disconnect plate 61 is a second quick disconnect plate 63 connected by air lines 64*a–e* to a pneumatic control panel 65 mounted upon the chamber 30. The control panel 65 is a conventional pneumatic control panel which includes an air manifold and air flow control circuits for routing air from a single air line source 65 to the air lines 64*a–e*.

The ports 64*p* in the quick disconnect plate 63 match the ports 62*p* of the quick disconnect plate 61 so that when the two plates are attached one to the other by conventional screws 70 and an alignment pin 71, the ports of the plate 63 will be sealingly secured to matching ports in the plate 61. Thereby, fluid communicatio between the pneumatic control panel 65 of the chamber 30 and the pumps and fluidizing bed chambers of the collector 25 may be quickly established. This quick establishment of pneumatic communication facilitates quick replacement of one powder collector 25 with another, thereby facilitating quick color change of the complete powder spray system 5.

In the operation of the system 5, a collector 25 with its recirculatio hopper 52 is moved into position under the table 10 and its supporting legs 18. The collector 25 is secured to the fan containing chamber 30 by conventional over-center or toggle type clamps or latches 89 and the gasket 91 moved vertically into engagement with the underside of the tables 10 by the toggles 96. The pneumatic lines 62 of the collector 25 are then attached to the pneumatic lines 64 from the control panel 65 by connectio of the quick disconnect plates 61, 63. The fan 31 is energized to suck or draw air downwardly from the booth through the opening 20 in the table and through the grate 90 into the cartridges 60. Air from the booth is pulled through the cartridges and blown out through the final filters 40. The reverse air jets are periodically operated to direct a reverse air flow of high pressure air into the cartridges at regular intervals. Powder is delivered to the gun 23 while product 15 is conveyed past the gun. Powder particles from the gun are directed toward the products 15. Generally, the products are grounded and an electrostatic charge is applied to the powder particles so as to cause the powder particles to adhere to the product. Oversprayed powder which does not adhere to the product falls by gravity or is drawn by the airstream within which it is entrained downwardly through the bottom of the booth and through the grate 90 into the cartridge containing collector 25. Any powder collected on the surface of the powder cartridges is periodically blown free of that surface by periodic reverse air blasts from the pulser jets 66. From the powder collectio hopper located beneath the cartridges, powder is sucked through the sieve 100 into the inlet conduit 76 and the powder transfer pump 73. This pump is then operative to transfer the powder via the hose or conduit 75 into the feed hopper 56. From the feed hopper the powder is recirculated via the feed pump 79 back to the spray gun 23. As mentioned hereinabove, the capacity of the transfer pump 73 is greater than the capacity of the pump 79 so that the powder within the feed hopper is always maintained at the level of an overflow port 58 interconnecting the interior of the feed hopper with the interior of the collection hopper. Powder in both of these hoppers is fluidized as a consequence of air flow passing upwardly through the bottom wall of the hoppers from fluidizing bed chambers located beneath each hopper. The fluidizing air and the turbulent air flow contained within the feed hopper is operable to maintain the sieve 100 in motion in the feed hopper and thereby to ensure that the surface of that sieve is periodically cleaned of contaminants which might otherwise clog the screen surface of that sieve.

The powder spray booth is subject to quicker color change than could be accomplished by removal of the powder collector 26, cleaning of booth 11, and replacement of the collector with another collector containing a different color powder. If very quick color change is desired at the sacrifice of slightly greater equipment costs, the legs 18 may be omitted or removable from the table 10. In that event, the booth 11 rests atop the supporting table or platform 10, and the supporting platform 10 rests atop and is supported from the collector 25. In this construction in which the booth is supported from the collector 30 when the collector 30 is disconnected by the latches 89 from the chamber 30, the booth and collector 25 are removable as a unit upon the rollers 51. Another booth and collector 25 may then be rolled into position adjacent the chamber 30 and connected thereto by the latches 89 of the new booth and collector combination. This construction of the system enables a color change to occur without the need to clean old powder from the booth before commencing the spraying of a new color powder from the gun 23.

From the above discussion of the general principles of the present invention and the preceding detailed description of a preferred embodiment, those persons skilled in the art to which this invention pertains will readily comprehend various modifications and changes to which the present invention is susceptible. Therefore, we desire to be limited only by the scope of the following claims.

Having described our invention, we claim:

1. A powder spray system comprising a powder spray booth through which product is conveyed, at least one powder spray gun associated with said booth for spraying powder onto products within said booth, a chamber located adjacent said powder spray booth, said chamber containing a fan and final filters, a powder collector in communication with said fan, said powder collector having at least one filter cartridge and a powder collection hopper located beneath said cartridge, said powder collection hopper having a bottom wall, said bottom wall comprising a fluidizing plate through which air passes to maintain a fluidized bed of powder within said collection hopper, a feed hopper, a transfer pump for transferring powder from said collection hopper to said feed hopper, a feed pump for transferring powder from said feed hopper to said spray gun, a flexible hose for conveying powder into said transfer pump, a sieve mounted upon the inlet end of said hose, and means for moving said sieve within said fluidized bed of said collection hopper so as to dislodge contaminants which collect on the sieve to facilitate transfer of powder through the sieve.

2. The powder spray system of claim 1 wherein feed hopper is located adjacent said collection hopper.

3. The powder spray system of claim 1 wherein said means for moving said sieve within said fluidized bed of said collection hopper comprises air passing through said fluidizing plate of said powder collection hopper.

4. The powder spray system of claim 1 wherein said sieve comprises a tubular body having a generally cylindrical side wall, at least one opening in said side wall, and a screen covering said opening in said side wall.

5. The powder spray system of claim 4 wherein said tubular body of said sieve has a pair of end walls, an outlet port in one of said end walls, and said inlet end of said flexible hose being connected to said outlet port of said sieve.

6. The powder spray system of claim 1 wherein said feed hopper is connected directly to said powder collection hopper, said feed hopper having an overflow outlet opening directly into said powder collection hopper such that powder may be maintained in said powder feed hopper at the level of said overflow outlet opening.

7. The powder spray system of claim 6 wherein both said powder collection hopper and said feed hopper have an air pervious bottom wall, said bottom wall of both of said hoppers being a top wall of a fluidizing bed chamber located beneath each of said hoppers.

8. The powder spray system of claim 1 wherein said powder spray booth is sealingly mounted atop a supporting platform, said powder collector being sealingly mounted to the underside of said supporting platform.

9. The powder spray system of claim 8 wherein said powder collection chamber is mounted upon wheels and is movable into and out of sealed engagement with said fan containing chamber and with the upstream side of said fan, the exhaust side of said fan being connected to said final filters.

10. A powder spray system comprising a powder spray booth through which product is conveyed, at least one powder spray gun associated with said booth for spraying powder onto products within said booth, a chamber located adjacent said powder spray booth, said chamber containing a fan and final filters, a powder collector in communication with said fan, said powder collector having at least one filter cartridge and a powder collection hopper located beneath said cartridge, said powder collection hopper having a bottom wall, said bottom wall comprising a fluidizing plate through which air is directed to maintain a fluidized bed of powder within said powder collection hopper, a feed hopper, a transfer pump for transferring powder from said collection hopper to said feed hopper, a feed pump for transferring powder from said feed hopper to said spray gun, a hose for conveying powder into said transfer pump, a sieve mounted upon the inlet end of said hose, and means for moving said sieve within said fluidized bed of powder within said collection hopper so as to dislodge contaminants from said sieve to facilitate transfer of powder through said sieve.

11. The powder spray system of claim 10 wherein said feed hopper is located adjacent to said powder collection hopper.

12. The powder spray system of claim 11 wherein said means for moving said sieve within said fluidized bed of powder within said collection hopper comprises air passing through said fluidizing plate of said powder collection hopper.

13. The powder spray system of claim 10 wherein said sieve comprises a tubular body having a generally cylindrical side wall, at least one opening in said side wall, and a screen covering said opening in said side wall.

14. The powder spray system of claim 13 wherein said tubular body of said sieve has a pair of end walls, an outlet port in one of said end walls, and said inlet end of said hose being connected to said outlet port in said one end wall.

15. A powder spray system comprising a powder spray booth through which product is conveyed, at least one powder spray gun associated with said booth for spraying powder onto products within said booth, a chamber located adjacent said powder spray booth, said chamber containing a fan and final filters, a powder collector, said powder collector having at least one filter cartridge and a powder collection hopper located beneath said cartridge, said powder collection hopper having a bottom wall, a feed hopper located adjacent to said powder collection hopper, a transfer pump means for transferring powder from said collection hopper to said feed hopper, a feed pump means for transferring powder from said feed hopper to said spray gun, said feed hopper being connected directly to said powdr collection hopper, said feed hopper having an overflow outlet opening directly into said powder collection hopper, said transfer pump means being operable to pump a greater quantity of powder into said feed hopper than said feed pump means supplies to said gun such that powder is always maintained in said powder feed hopper at the level of said overflow outlet opening.

16. The powder spray system of claim 15 wherein both said powder collection hopper and said feed hopper have an air pervious bottom wall, said bottom wall of both of said hoppers being a top wall of a fluidizing bed chamber located beneath each of said hoppers.

17. The powder spray system of claim 15 wherein said powder spray booth is sealingly mounted atop a supporting platform, said powder collector being sealingly mounted to the underside of said supporting platform.

18. The powder spray system of claim 17 wherein said powder collection chamber is mounted upon wheels and is movable into and out of sealed engagement with the upstream side of said fan, the exhaust side of said fan being connected to said final filters.

* * * * *